United States Patent [19]

Holtrop, deceased et al.

[11] 4,157,701

[45] Jun. 12, 1979

[54] DIESEL ENGINE CONTROL MEANS

[76] Inventors: Peter B. J. Holtrop, deceased, late of Carson, Calif., by Juliet Holtrop, executrix, 1500 Cyrene St., Carson, Calif. 90746; John T. Hewitt, 1021 Camino Real, Redondo Beach, Calif. 95709

[21] Appl. No.: 806,615

[22] Filed: Jun. 15, 1977

[51] Int. Cl.[2] ..... F02D 1/04

[52] U.S. Cl. ..... 123/140 MC; 123/140 MP; 123/198 DB

[58] Field of Search ..... 123/140 MC, 140 MP, 123/198 DB; 60/277, 285; 251/139

[56] References Cited

U.S. PATENT DOCUMENTS

| | | | |
|---|---|---|---|
| 3,605,711 | 9/1971 | Fuso | 123/140 MC |
| 3,606,872 | 9/1971 | Eckert | 123/140 MC |
| 3,742,919 | 7/1973 | Sudo | 123/140 MP |
| 3,795,233 | 3/1974 | Crews et al. | 123/140 MP |
| 3,842,811 | 10/1974 | Shinoda et al. | 123/140 MC |
| 3,927,649 | 12/1975 | Stumpp | 123/140 MP |
| 3,981,285 | 9/1976 | Schucker et al. | 123/140 MP |
| 3,993,032 | 11/1976 | Passera et al. | 123/140 MC |
| 4,020,814 | 5/1977 | Hewitt et al. | 123/140 MC |
| 4,058,101 | 11/1977 | Taira et al. | 123/140 MP |
| 4,068,642 | 1/1978 | Little, Jr. | 123/140 MP |

*Primary Examiner*—Ronald H. Lazarus
*Assistant Examiner*—R. A. Nell
*Attorney, Agent, or Firm*—Fulwider, Patton, Rieber, Lee & Utecht

[57] ABSTRACT

There is disclosed an automatic control system for limiting the operating temperature of a diesel engine having a pressurized intake manifold such as a turbocharged diesel engine. The system includes a pyrometer to sense the exhaust gas temperature from the engine and generate a signal therefrom, a temperature controller having an adjustable, maximum set point temperature to receive the signal from the pyrometer and to generate a control signal which is applied to a control valve in the manifold pressure line which applies manifold pressure to a pressure cell such as an aneroid unit that proportionally controls the position of the rack of the fuel supply. The control valve vents the manifold pressure line to the atmosphere and reduces the pressure on the aneroid unit to reposition the fuel rack in response to a sensed exhaust gas temperature which exceeds the preselected maximum set point temperature.

7 Claims, 2 Drawing Figures

DIESEL ENGINE CONTROL MEANS

BACKGROUND OF THE INVENTION

1. Field of Invention:

This invention relates to diesel engines and, in particular, to a control system for turbocharged diesel engines.

2. Brief Statement of Prior Art:

A common cause of damage and excessive wear of internal combustion engines results from excessive combustion temperatures in the engine. The operational temperature of the engine can rapidly exceed a safe operational limit by improper operation where the engine is overloaded at any speed, requiring overthrottling and an excessive rate of fuel injection. This often occurs when driving a diesel-powered vehicle into unnoticed head or side winds or climbing unnoticed grades, or failing to notice changes in ambient pressure resulting from altitude changes or high ambient tempertures. Additionally, malfunctions in the engine and its accessory equipment such as in the fuel supply system or fuel injectors, improper timing, turbocharger, restricted air cleaner, leak in a cross over tube, etc. can also cause an improper supply of fuel to the engine and result in an excessive operational temperature of the engine.

When the temperature of an engine exceeds a safe operational temperature, even for periods of relatively short duration, the damage that can be expected includes burned valves, head gasket failures, engine block distortion, cracked manifold and cylinder heads, burning and scoring of pistons, carbon deposits behind piston rings and on injector tips, piston ring failure with resultant high oil consumption and blow by, lubrication oil dilution, cracks in the turbocharger unit and expansion of aluminum pistons resulting in aluminum deposits on cylinder walls and piston sizure.

It is generally recognized that the engine temperature of a diesel engine is critically affected by the aforementioned operational or equipment defects. As a result, many diesel engines are provided with pyrometers to monitor the exhaust gas temperature of the engine. Some of the pyrometers have been equipped with visual or audible warning signal generators to alert the operator when the exhaust gas temperature exceeds a predetermined, safe operational level. These devices are not entirely satisfactory since the warning signals can be inadvertently or deliberately ignored during operation of the engine. Since operations of relatively short durations at excessive temperatures can have disastrous effects on the engine, any failure to take corrective steps immediately upon indication of an excessive exhaust gas temperature, can result in an expensive and time consuming engine overhaul. Unmanned engines present similar problems.

In our prior patent, we disclosed and claimed a control system for a conventional, normally aspirated diesel engine using a controlled fuel by-pass. There is also disclosed in U.S. Pat. No. 3,605,711 a hydraulic control system which adjusts the position of a fuel rack in an on-off, non-proportional manner. None of these prior systems are particularly adaptable to pressurized induction engines such as turbocharged engines.

BRIEF STATEMENT OF THE INVENTION

This invention comprises an automatic temperature control system for use on a diesel engine. The invention comprises an engine exhaust gas temperature sensing pyrometer that generates a signal proportional to the engine exhaust gas temperature, control means which receives the generated signal, compares the signal to a preselected reference which corresponds to a maximum safe operational engine temperature and generates a control signal when the sensed temperature signal exceeds the preselected signal level, and control means operative to vary the fuel flow rate to the engine in response to the control signal, decreasing the fuel flow rate to the engine in response to a sensed, excessive exhaust gas temperature.

The control system of the invention can be employed on turbocharged engines which have an fuel ratio control aneroid by simply installing a control valve to vent air pressure from the fuel ratio control aneroid and thereby effect control of the fuel supply to the engine.

BRIEF DESCRIPTION OF THE DRAWINGS

The invention is illustrated in the drawings of which.

DESCRIPTION OF THE PREFERRED EMBODIMENTS

Figure 1:
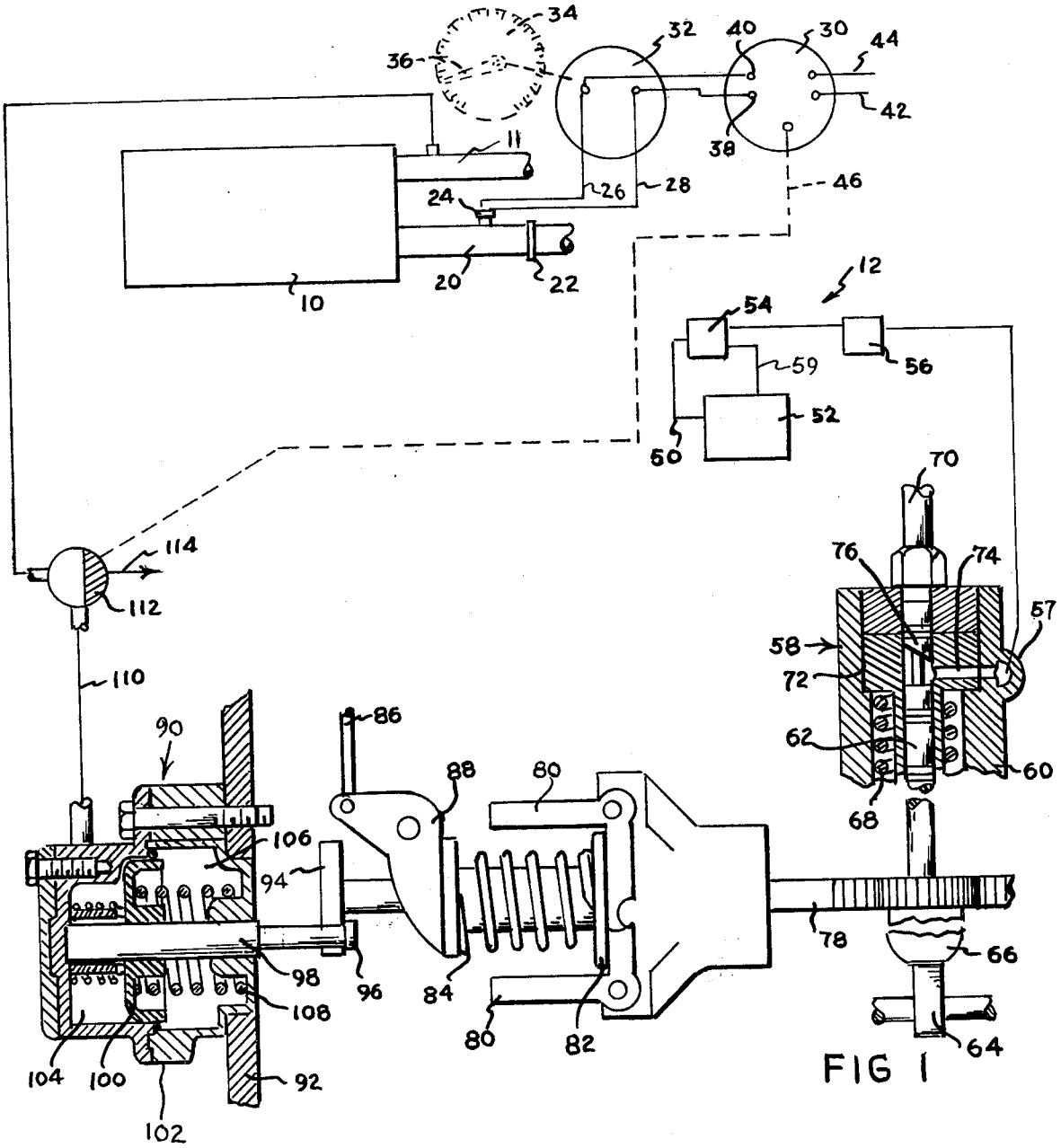
FIG. 1 illustrates the invention with a diesel system having a pressurized induction system.

Referring now to FIG. 1, there is illustrated a diesel engine 10 which has a fuel supply system gernerally indicated at 12 to supply fuel under high pressure to each of a plurality of metering valves and injectors, one for each of the multiple cylinders of the engine. The engine 10 is a conventional diesel engine which normally operates at a compression ratio from 13.5:1 to about 18:1 and which has a pressurized intake manifold 11 such as a supercharged or turbocharged engine. The compression of the air in the engine cylinders raises the air temperature sufficiently to ignite the fuel as it is injected into the cylinders. The engine can have from 2 or more cylinders arranged in-line or in parallel banks as in a V-6, V-8 or V-12 configuration.

The engine is provided with an exhaust gas manifold, generally indicated at 20, which can be a single manifold for in-line engines or can be two, parallel exhaust gas manifolds for V-cylinder configurations. The exhaust gas manifolds are usually of cast iron and have a flange fitting 22 for attachment of steel exhaust tubes and the like.

The invention is applied to these engines by fitting the exhaust gas manifold with pyrometer means 24 that is preferably located in the exhaust gas manifold to obtain reliable temperature indications. The pyrometer means is typically a thermocouple which is installed by tapping a threaded bore in the exhaust manifold at the appropriate location. The thermocouple wires are connected to parallel lead wires 26 and 28 which extends to control means 30.

Preferably, leads 26 and 28 are connected to a temperature display meter 32 having a display face 34 that is provided with a dial bearing indicia calibrated in temperature, typically in degrees Fahrenheit, and a pointer 36 to indicate to the operator the exhaust gas temperature that is sensed by pyrometer means 24.

The thermocouple, when used as the pyrometer means, is operative to generate an analog direct current (D.C.) millivolt signal reflective of the exhaust gas temperature. This D.C. signal is applied to the input terminals 38 and 40 of control means 30. The control means 30 is also provided with a supply of battery voltage by lead wires 42 and 44.

Control means 30 is a solid state controller having an operational amplifier receiving the input voltage signal from the thermocouple and referenced to generate a control signal when the sensed temperature exceeds a predetermined value. The thermocouple is connected between the wiper of a potentiometer and the operational amplifier which is driven in an operational mode by receiving a reference lead input from a voltage divider. The potentiometer is adjustable to provide adjustment of the maximum safe operational temperature to any desired safe temperature of operation for the particular engine. This temperature is generally from 500° to about 1800° F. for internal combustion engines and, typically for diesel engines, from 500° to 1350° F. The operational amplifier output can, if desired, be connected to a first driver through a ground loop isolating optical coupler to avoid spurious signals generated by other equipment. The first driver is connected to an audio alarm and across a slow charge, fast discharge time delay to a second driver that produces a control signal to lead 46.

As previously mentioned, the diesel engine has a fuel system with separate metering valves and injectors for each cylinder. Commonly, these engines are turbocharged and include an aneroid unit which is responsive to the intake manifold pressure to control the fuel flow to the engine. The fuel system comprises reservoir 52, supply line 50, a transfer pump 54, filter 56 and injection manifold 57. Commonly, transfer pump 54 supplies an excess flow of fuel which is bypassed through line 59 to reservoir 52.

FIG. 1 shows one of the plurality of fuel metering valves 58 which are provided, one per cylinder, and are conventionally housed in a single pump housing 60. The pump plunger 62 is driven by cam 64 of engine 10 through lifter 66 and held against the cam 64 by spring 68. The amount of fuel delivered to injection line 70 by the pump plunger depends on the rotational position of the plunger in barrel 72 since the timing of the opening and closing of fuel supply port 74 is controlled by the angular position of the helical scroll 76 of plunger 62. With the scroll 76 oriented as illustrated, maximum fuel is delivered since the port 74 remains blocked through the major distance of travel of plunger 62. When the scroll is rotated to open port 74 earlier in travel of plunger 62, high pressure fuel from above plunger 62 is vented beneath the helical scroll into port 74.

The position of helical scroll 76 is controlled by reciprocation of rack 78 that is coupled to a mechanical governor having double flyweights 80 which move retainer 82 against spring 84 to withdraw rack 78 and decrease the high pressure fuel displacement of plunger 62. The throttle linkage 86 is linked to rack 78 by lever 88.

The position of rack 78 is also controlled in response to the intake manifold pressure by manifold unit 90 which is a pressure cell, such as an aneroid unit that is connected to the intake manifold 11 by conduit 92 so that an increase in manifold pressure such as resulting from turbocharging will extend rack 78 and increase the fuel delivered by plunger 62.

The aneroid unit is a conventional fuel ratio control which is mounted on the governor housing 92 and which restricts movement of the fuel rack during engine operation by coordinating movement of the fuel rack with the amount of air (pressure) in the intake manifold 11.

When the operator depresses the accelerator to increase engine speed, lever 88 moves rack 78 to increase the open port area by rotating helical scroll 76. The fuel rack has a fixedly attached collar 94 which slidably receives a bolt 96. The head of bolt 96 functions as a stop limiting the travel of fuel rack 78.

Bolt 96 is secured in valve member 98 which is attached to a flexible diaphragm 100 which divides the aneroid housing 102 into a pressurized chamber 104 and an atmospheric chamber 106. Chamber 106 contains helical coil spring 108 which is biased to retract the valve member 98 into the aneroid housing.

The manifold pressure line 110 is connected to pressurized chamber 104 and applies manifold pressure, developed by the boost of air pressure from the supercharger or turbocharger or the opposite side of the diaphragm 100, against the bias of spring 108. The application of superatmospheric pressure to chamber 104 moves bolt 96 away from collar 94 and permits the fuel rack to move toward an increased fuel supply position.

Figure 2:
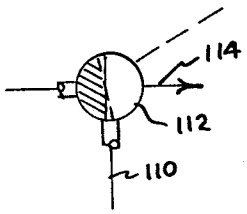
FIG. 2 illustrates the varied position of the control value responsive to an excessive exhaust gas temperature.

This invention controls the aforedescribed system by the operation of solenoid valve 112 which is proportionally responsive to the control signal transmitted by lead 46 from controller 30. The valve 112 vents line 110 through conduit 114 to the atmosphere in response to a control signal from controller 30 and thereby reduces the pressure applied to aneroid unit 90, withdrawing rack 78 and limiting the fuel flow. FIG. 2 shows the venting position of valve 112 in a full venting position (solid lines) and a throttled venting position (broken line). In this manner, the control signal from control unit 30 is applied to the governor control of the engine to effect engine control. To provide adjustability of the control for various engines, an adjustable means such as bolt 96 can be threadably received in valve member 98.

The invention as thus described can be seen to comprise means for the automatic regulation of the fuel supply to a diesel engine in response to engine exhaust gas temperature. The control system of the invention can be readily installed on a diesel engine. The system only requires the tapping of a threaded bore in the exhaust manifold, mounting of the pyrometer means therein, and the installation of a control valve in an appropriate location in the manifold pressure line to the aneroid unit. The instruments such as the visual temperature indicator and the control unit can be remotely mounted on an instrument panel of a fixed or mobile diesel engine. Since the system does not rely upon mechanical interconnection between the remote units and the pyrometer or control valve, ease of installation is assured.

When installed, the system insures against improper operation of the diesel engine tht may result from incorrect operator practices such as overthrottling of the engine or from defects in the fuel or air supply system which could lead to excessive engine operational temperatures. The device does not rely upon the operator intervention to make the necessary corrections that would prevent the engine temperature from reaching an unsafe value. Instead, the control system provides for the automatic regulation of the fuel supply system by providing an automatic means for limitation of fuel supply to the engine when the exhaust gas temperature reaches the preselected maximum that is reflective of the maximum safe operational temperature for the engine. Because the control is effected automatically, it cannot be inadvertently or intentionally ignored and, accordingly, operation of the engine, even for short durations, at excessive temperatures is thereby prevented.

The invention has been described with reference to the presently preferrred and illustrated embodiments thereof. It is not intended that the invention be unduly limited or restricted by this disclosure of the preferred embodiments. Instead, it is intended that the invention be defined by the means and their obvious equivalents set forth in the following claims.

I claim:

1. In an internal combustion engine having multiple cylinders and fuel supply means including multiple metering valves and injectors, one for each of said cylinders, with a rack mechanism to control the volume of fuel delivered by said metering valves and injectors and an aneroid unit connected by a line to the intake manifold of said engine to apply the pressure of the intake manifold to said aneroid the improvement which comprises an engine exhaust gas temperature sensing means to generate a sensed signal responsive to engine exhaust gas temperature;

control means to receive said sensed signal, compare said signal to a preset signal level corresponding to a maximum safe operational engine temperature, and to generate a control signal therefrom when said sensed signal exceeds said preset signal level;

excess temperature control means which comprises valve means in said line from said aneroid unit to said intake manifold; and means interconnecting said control means to said valve means to actuate said valve means and reduce the pressure applied to said aneroid unit in response to said control signal.

2. The engine of claim 1 including turbocharging means to deliver pressure air to said intake manifold.

3. The engine of claim 1 wherein said valve means vents said line to the atmosphere.

4. The engine of claim 3 wherein said temperature sensing means is a thermocouple positioned in the exhaust gas manifold of said engine and operative to generate a direct current sensed signal.

5. The engine of claim 3 wherein said control means generates a direct current control signal including adjustment means carried by said control means whereby the value of said preset signal level can be fixedly adjusted.

6. The engine of claim 1 wherein said valve means comprises an electrical solenoid valve.

7. The engine of claim 6 wherein said solenoid valve is moveable between a position transmitting the intake manifold pressure through said line to said aneroid unit and a venting position closing said line to said intake manifold and venting said aneroid unit to atmosphere.

* * * * *